US007144436B2

(12) United States Patent
Barbour et al.

(10) Patent No.: US 7,144,436 B2
(45) Date of Patent: Dec. 5, 2006

(54) FUEL COMPOSITION

(75) Inventors: Robert Howie Barbour, Ashbourne (GB); Stuart Pace, Winchester (GB); Alan Mark Schilowitz, Highland Park, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 455 days.

(21) Appl. No.: 10/203,734

(22) PCT Filed: Mar. 8, 2001

(86) PCT No.: PCT/EP01/02620

§ 371 (c)(1),
(2), (4) Date: Nov. 5, 2002

(87) PCT Pub. No.: WO01/66674

PCT Pub. Date: Sep. 13, 2001

(65) Prior Publication Data

US 2003/0150155 A1 Aug. 14, 2003

(30) Foreign Application Priority Data

Mar. 10, 2000 (GB) ..... 0005936.0

(51) Int. Cl.
*C10L 1/18* (2006.01)
*C10L 1/182* (2006.01)

(52) U.S. Cl. ..... 44/436; 44/451

(58) Field of Classification Search ..... 44/436, 44/451

See application file for complete search history.

(56) References Cited

U.S. PATENT DOCUMENTS 5,288,393 A * 2/1994 Jessup et al. ..... 208/16
H1305 H * 5/1994 Townsend et al. ..... 44/449
5,653,866 A * 8/1997 Jessup et al. ..... 208/46

FOREIGN PATENT DOCUMENTS

WO WO 99/49003 9/1999
WO WO 01/21738 A1 3/2001

OTHER PUBLICATIONS

Kirk-Othmer, *Encyclopedia of Chemical Technology, Third Edition*, vol. 17—Peroxides and Peroxy Compounds, Inorganic to Piping Systems, John Wiley & Sons, 1982. pp. 217 and 219.

F.D. Stump, et al., "Influence of Ethanol-Blended Fuels on the Emissions from Three Pre-1985 Light-Duty Passenger Vehicles", *Journal of the Air & Waste Management Association*, vol. 46, Dec. 1996.

* cited by examiner

*Primary Examiner*—Cephia D. Toomer
(74) *Attorney, Agent, or Firm*—Gary P. Katz

(57) ABSTRACT

A fuel composition comprising gasoline having a sulphur content of less than 10 ppm by weight and an aromatic content of less than 25% by volume, characterized in that said composition comprises at least 5% by volume of olefins and is substantially free of any ethers. The fuel composition so formed has reduced emissions and improved fuel economy. The emissions from such compositions can be further reduced by incorporating therein a small amount of ethanol.

8 Claims, No Drawings

FUEL COMPOSITION

This invention relates to fuel compositions of ultra-low sulphur and low aromatics content which have improved friction properties and hence adequate lubricity thereby having improved wear control and acceptable combustion performance.

Fuels such as motor gasoline are widely used in automotive transport. However, in line with the general thrust to reduce air pollution, petroleum companies and vehicle manufacturers are looking to develop systems that have reduced exhaust emissions and improved fuel economy. The petroleum companies in turn are introducing fuels with low sulphur content as they are considered to be more compatible with exhaust catalyst systems. One of the methods of reducing the sulphur content is to subject the fuel to hydrotreatment. One of the problems with such fuels with relatively low sulphur content is that the reduction of sulphur content also adversely affects the lubricity of the resultant fuel. For instance, low sulphur fuels may lead to premature wear in some submerged electric gasoline pumps. Low sulphur distillate fuels have also been shown to have an adverse wear effect on diesel fuel system components such as rotary fuel pumps and fuel injection systems. Moreover, improved fuel lubricity may also lead to improved fuel economy. The hydrotreatment process also reduces the olefinic content of the fuel since hydrogenation saturates the olefins therein during the process of sulphur removal. Loss of olefins adversely affects the performance of gasoline since olefins are key contributors to octane performance. This drawback has been met hitherto by the use of octane improvers such as e.g. methyl tertiary butyl ether. However, the use of the latter has recently been called into question for environmental reasons and has fallen out of favour. Consequently, it is necessary to formulate fuel compositions which are low in sulphur content but are also of the desired lubricity in order to minimise wear and friction when used in automotive engines. At the same time, it is desirable to retain the octane performance of the fuel. In addition to the issue of low sulphur, the presence of relatively high levels of aromatics in the fuels also adversely affect performance in that they give rise to undesirable emissions, especially of hydrocarbons, and can also cause combustion chamber deposits which again exacerbates the undesirable effect on emissions. Thus, whilst improving the lubricity performance of the fuel and sufficient octane level, it is also essential to control the aromatic content thereof to meet the current and impending future regulations on exhaust emissions. Consequently, it can be difficult to simultaneously produce motor gasoline with high octane, good lubricity and good emissions performance.

It has now been found that the lubricity and octane performance of ultra-low sulphur fuels can be restored whilst controlling the aromatic content thereof by increasing the olefinic content thereof without recourse to the use of ethers.

Accordingly, the present invention is a fuel composition comprising gasoline having a sulphur content of less than 10 ppm by weight and an aromatic content of less than 25% by volume, characterized in that said composition comprises at least 5% by volume of olefins and is substantially free of any ethers.

As described above, the sulphur content of the fuel composition is less than 10 ppm by weight, is preferably less than 5 ppm by weight. Such low sulphur levels can be achieved in a number of ways. The base fuels may comprise mixtures of saturated, olefinic and aromatic hydrocarbons and these can be derived from straight run streams, thermally or catalytically cracked hydrocarbon feedstocks, hydrocracked petroleum fractions, catalytically reformed hydrocarbons, or synthetically produced hydrocarbon mixtures. Typically, the present invention is applicable to fuels such as the light boiling gasoline (which typically boils between 50 and 200° C.), especially motor gasoline. The sulphur content of such fuels can be reduced below the 10 ppm level by well known methods such as eg, catalytic hydrodesulphurisation. The lubricity properties of ultra-low sulphur (<10 ppm) base fuels which have an aromatic content of less than 25% by volume, preferably less than 20% by volume are generally poor. These fuels particularly benefit from the presence of olefins therein in an amount of at least 5% by volume, suitably at least 10% by volume and preferably from 10–25% by volume, eg 15% by volume of the total fuel.

The olefins that may be used for this purpose are suitably $C_3$–$C_{10}$ mono-olefins and are preferably alpha-olefins. Thus, the olefins may be one or more selected from the group consisting of pent-1-ene, hex-1-ene, hept-1-ene, oct-1-ene, non-1-ene and dec-1-ene.

Fuel compositions comprising gasoline as the base fuel in general are susceptible to evaporative losses and the consequent release of volatile hydrocarbons and other organics is a cause for environmental concern. Such volatile losses can occur in distribution systems, during fuelling, during vehicle operation (running losses) and even while the vehicle is parked (diurnal losses). Such release of hydrocarbons and organics into the environment can contribute to ozone production and can be a direct source of toxic components such as e.g. benzene. The volatility of gasoline is usually quantified by the vapour pressure of the gasoline composition and the industry standard is RVP (Reid Vapour Pressure) according to the so-called Setavap procedure (ASTM D5191-96). It is recognised that the lower the RVP value, the lower the emissions from such compositions.

It is a legal requirement in some countries, e.g. the USA, that fuels incorporate oxygen in the fuel, which oxygen may be present in the form of an organic oxygen containing compound. Ethanol is one such compound. However, according to the SAE publication "Automotive Fuels", Edited by Keith Owen and Trevor Coley, published by SAE (1995), Chapter 11, ethanol actually increases dramatically the RVP of a gasoline composition containing the same. Thus, it would have been expected that in addition to increasing evaporative emissions, presence of ethanol would also lead to driveability and operability problems. Surprisingly, it has now been found that the fuel compositions of the present invention may further benefit by adding ethanol thereto and reduces emissions due, e.g., to running losses and dirunal losses.

The amount of ethanol used for this purpose is greater than 0.5% by volume, suitably greater than 1.0% by volume and is preferably in the range from 1.5 to 10.0% by volume, more preferably from 5 to 10% by volume of the total fuel composition. In this manner the RVP debit associated with ethanol addition can be reduced.

Thus according to a further embodiment, the present invention is a fuel composition comprising gasoline having a sulphur content of less than 10 ppm by weight and an aromatic content of less than 25% by volume, characterized in that said composition comprises at least 5% by volume of olefins, greater than 0.5% by volume of ethanol and is substantially free of any ethers.

A feature of the invention is the ability of the olefins to reduce the reported adverse effects of ethanol on the RVP of gasoline compositions. This ability of the olefins had not been recognised hitherto. Thus, the RVP debit associated with ethanol addition can be reduced by at least 0.69 kPa (0.1 psi) by using a gasoline composition according to the present invention. This reduction may appear insignificant in absolute terms but in terms of overall evaporative losses of fuel, it is a substantial reduction. Since the tendency of current environmental legislation throughout the world is to progressively reduce sulphur and aromatics content of fuels and also to minimise RVP at the same time ensuring that the composition has adequate volatility for efficient combustion, the benefits to the industry are all too apparent.

The fuel compositions of the present invention can be prepared by blending the various components into a base fuel. All of the olefins and aromatics can be blended as part of the refining process during the preparation of the fuel itself since these are readily soluble and miscible with the base fuel. The blending of ethanol may have to be carried out at the point of distribution, in spite of its solubility in the base fuel, to comply with requirements in certain countries which disapprove of such compositions containing ethanol being transported via pipelines.

Thus, the present invention provides a fuel with relatively good lubricity and high octane performance while attaining low vehicle emissions.

The present invention is further illustrated with reference to the following Examples. The ultra-low sulphur motor gasoline used in the Examples was prepared from a blend of refinery streams. Into this gasoline was blended a mixture of olefinic hydrocarbons prepared from commercial chemicals to mimic those found in gasoline. The resulting gasoline-olefin blends were analysed by FIA to measure the levels of olefins and aromatics therein and the performance of these blends was evaluated using the HFRR technique described below under the standard motor gasoline conditions. As a comparison base fuels with higher levels of sulphur were also tested. The various analyses and performance results are tabulated below:

The antiwear and lubricity performance of the fuel compositions of the present invention were measured according to the so-called high frequency reciprocating rig test (hereafter referred to as "HFRR"). The HFRR test consists of a loaded upper ball 6 mm in diameter, which oscillates against a static lower plate. Both friction and contact resistance are monitored throughout the test. The tests are conducted largely according to the standard procedure published as CEC F-06-A-96 in which a load of 2N (200 g) was applied, the stroke length was 1 mm, the reciprocating frequency was 50 Hz and sample temperature of 25° C. The ambient temperature and humidity were controlled within the specified limits and the calculated value of wear scar diameter was corrected to the standardized water vapour pressure of 1.4 kPa. The specimen ball was a grade 28 (ANSIB3.12), AISI E-52100 steel with a Rockwell hardness "C" scale (HRC) number of 58-66 (ISO 6508), and a surface finish of less than 0.05 μm $R_a$, and the lower plate was AISI E-52000 steel machined from annealed rod, with a Vickers hardness "HV30" scale number of 190-210 (ISO 6507/1). It is turned, lapped and polished to a surface finish of 0.02 μm $R_a$.

TABLE 1

| Summary of HFRR test conditions | | | |
|---|---|---|---|
| Fluid volume, ml | 3.6 ± 0.20 | Specimen steel | AISI E-52100 |
| Fluid temperature, ° C. | 25 | Ball diameter, mm | 6.00 |

TABLE 1-continued

| Summary of HFRR test conditions | | | |
|---|---|---|---|
| Bath surface area, $cm^2$ | 6.0 ± 1.0 | Surface finish (ball) | <0.05 μm Ra |
| Stroke length, mm | 1.0 ± 0.02 | Hardness (ball) | 58–66 Rockwell C |
| Frequency, Hz | 50 ± 1 | Surface finish (plate) | <0.02 μm Ra |
| Applied load, g | 200 ± 1 | Hardness (plate) | 190–210 HV 30 |
| Test duration, minutes | 75 ± 0.1 | Ambient conditions | See text |

TABLE 2

FIA ANALYSIS

| | Components | | | | | |
|---|---|---|---|---|---|---|
| | 1 | 2 | 3 | 4 | 5 | 6 |
| Aromatics | 22 | 22 | 21 | 21 | 44.7 | 38.7 |
| Olefins | 0.6 | 4.8 | 8.5 | 9.4 | 2.3 | 6.2 |
| Sulphur* | 9 | — | — | — | 51 | 180.0 |

*measured by UV fluorescence (ASTM D5453-93)

TABLE 3

HFRR TEST RESULTS

| | Parameters | | | | | |
|---|---|---|---|---|---|---|
| | 1 | 2 | 3 | 4 | 5 | 6 |
| Olefin content (%) | 0.5 | 5.0 | 8.5 | 9.5 | 2.3 | 6.2 |
| Friction | 0.513 | 0.482 | 0.459 | 0.428 | — | — |
| Wear Scar (μm) | 912 | 909 | 883 | 826 | 862 | 827 |

TABLE 4

HFRR WEAR-SCAR (μm) OF MOTOR GASOLINE WITH INCREASING OLEFIN AND SULPHUR CONTENT

| | Sulphur Content (ppm) | | |
|---|---|---|---|
| Olefins (wt %) | <10 | 50 | 180 |
| 0.5 | 912 | 862 | 827 |
| 5.0 | 909 | | |
| 8.5 | 883 | | |
| 9.5 | 826 | | |

The above results show that by reducing the sulphur content and aromatic content has an adverse effect on lubricity. They also show that this deterioration can be reversed by increasing the olefin content of the fuel.

In respect of RVP testing base fuel A was prepared according to the composition shown in Table 5 below where the values (%) are by volume.

TABLE 5

| Fuel | Sulphur (ppm) | RVP (kPa) | Olefins (%) | Aromatics (%) | Saturates (%) |
|---|---|---|---|---|---|
| A | 9 | 52.1 | 0.3 | 22 | 77.5 |

The RVP test results are shown in Table 6 below:

TABLE 6

| Add Hydrocarbon vol % | RVP kPa | Add EtOH vol % | RVP kPa | EtOH Effect kPa | Avg. Effect |
|---|---|---|---|---|---|
| Base Fuel A | 52.1 | 5 | 58.6 | 6.5 | |
| 5 Saturates | 50.6 | 5 | 58.3 | 7.7 | |
| 10 Saturates | 50.4 | 5 | 58.5 | 8.1 | 7.9 |
| 15 Saturates | 50.6 | 5 | 58.4 | 7.8 | |
| 5 Olefins | 51.2 | 5 | 58.7 | 7.5 | |
| 10 Olefins | 52.2 | 5 | 59.2 | 7.0 | 7.3 |
| 15 Olefins | 53.0 | 5 | 60.4 | 7.4 | |
| 5 Aromatics | 48.3 | 5 | 55.9 | 7.6 | |
| 10 Aromatics | 46.3 | 5 | 53.9 | 7.6 | 7.6 |
| 15 Aromatics | 44.3 | 5 | 52.0 | 7.7 | |

The invention claimed is:

1. A fuel composition comprising gasoline having a sulphur content of less than 10 ppm by weight and an aromatic content of less than 25% by volume, characterized in that said composition comprises at least 15–25% by volume of olefins and is substantially free of any ethers.

2. A fuel composition according to claim 1 wherein the sulphur content of the fuel composition is less than 5 ppm by weight.

3. A fuel composition according to claim 1 or 2 wherein the aromatic content of the composition is less than 20% by volume.

4. A fuel composition according to any one of the preceding claims wherein the olefin present in said composition comprises one or more of $C_3$–$C_{10}$ olefins.

5. A fuel composition according to any one of the preceding claims wherein the olefin present in said composition is selected from one or more of pent-1-ene, hex-1-ene, hept-1-ene, oct-1-ene, non-1-ene and dec-1-ene.

6. A fuel composition of reduced RVP comprising gasoline having a sulphur content of less than 10 ppm by weight and an aromatic content of less than 25% by volume, characterized in that said composition comprises at least 5% by volume of olefins, greater than 0.5% by volume of ethanol and is substantially free of any ethers.

7. A fuel composition according to claim 6 wherein the amount of ethanol present in said composition is in the range from 1.5 to 10.0% by weight of the total fuel composition.

8. A fuel composition according to claim 6 or 7 wherein said composition has an RVP value below 62 kPa (9 p.s.i.).

* * * * *